US006986507B2

(12) United States Patent
Weetman

(10) Patent No.: US 6,986,507 B2
(45) Date of Patent: Jan. 17, 2006

(54) MASS TRANSFER METHOD

(75) Inventor: Ronald J. Weetman, Rochester, NY (US)

(73) Assignee: SPX Corporation, Charlotte, NC (US)

( * ) Notice: Subject to any disclaimer, the term of this patent is extended or adjusted under 35 U.S.C. 154(b) by 37 days.

(21) Appl. No.: 10/284,234

(22) Filed: Oct. 31, 2002

(65) Prior Publication Data

US 2004/0062143 A1 Apr. 1, 2004

Related U.S. Application Data

(60) Provisional application No. 60/413,445, filed on Sep. 26, 2002.

(51) Int. Cl.
*B01F 7/20* (2006.01)

(52) U.S. Cl. ..... 261/85; 366/330.1

(58) Field of Classification Search ..... 261/84, 261/85; 366/286, 330.1–330.7
See application file for complete search history.

(56) References Cited

U.S. PATENT DOCUMENTS 3,656,974 A * 4/1972 Mihalyi et al. ..... 99/348
5,988,604 A 11/1999 McWhirter ..... 261/91
6,270,061 B1 * 8/2001 Bouquet et al. ..... 261/87
6,517,729 B2 * 2/2003 Campo et al. ..... 210/758
6,585,854 B2 * 7/2003 Scherzinger et al. ..... 162/55

OTHER PUBLICATIONS

Kamil Wichterle, "Free Level Effect on the Impeller Power Input in Baffled Tanks", Collect. Czech. Chem. Commun. vol. 60, 1995, pp. 1274–1280.*

Wichterle et al., "Surface AerationThreshold in Agitated Vessels", Collect. Czech. Chem. Commun. vol. 61, 1996, pp. 681–690.*

John von Essen, "Mass Transfer in a Fluid Mixer", Feb. 1999.*

* cited by examiner

*Primary Examiner*—David Sorkin
(74) *Attorney, Agent, or Firm*—Baker Hostetler LLP

(57) ABSTRACT

A more efficient process and method for dispersing gas or other fluids into a liquid which may have solid suspension. More particularly, the process includes maximizing the transfer of oxygen by an impeller by selecting a Froude Number value and/or Surface Power Density value and analyzing these two relative to the desired Standard Aeration Efficiency value desired for the impeller.

12 Claims, 4 Drawing Sheets

MASS TRANSFER METHOD

This application claims priority to the provisional U.S. patent application entitled, MASS TRANSFER METHOD AND PROCESS, filed Sep. 26, 2002, having a Ser. No. 60/413,445, the disclosure of which is hereby incorporated by reference.

FIELD OF THE INVENTION

The present invention relates to a mass transfer process and method. More particularly, the present invention relates to a more efficient process for dispersing gas or other fluids into a liquid which may have solid suspension. The invention is useful, for example, for use in waste treatment plants for introducing oxygen into water that is utilized by biological elements that digest the waste. The invention is also useful in various other bio-reaction processes.

BACKGROUND OF THE INVENTION

In mass transfer processes such as waste treatment and bio-reactions, it is common to carry out these processes in a stirred vessel in which gas, such as oxygen or an oxygen containing gas, is introduced into a liquid containing a solid phase and/or micro-organisms therein. These aforementioned processes are oftentimes utilized by municipalities and industry to treat waste wherein the object of the process is to introduce oxygen to the liquid and the micro-organisms in the liquid can then proceed to use this oxygen to digest the waste. The gas is commonly introduced by means of sparge pipes into a tank containing liquid and/or use of a surface aerator such as an impeller.

During the treatment process, the gas is initially introduced to the liquid, and after a period of time, the micro-organisms will have effected sufficient reaction for clear and/or treated liquid to be run off, possibly after a settling stage.

One disadvantage with these processes is that they are very inefficient. The length of time required to effect the reaction can be as long as 24 hours. This time period combined with the fact that these waste treatment processes are oftentimes carried out continuously year round, provide a process that is very inefficient in terms of both time consumption and energy consumption.

Accordingly, it is desirable to provide a mass transfer process for effectuating the energy efficient dispersement or transfer gas or other fluids into a liquid or liquid suspension in mixing systems.

SUMMARY OF THE INVENTION

The foregoing needs are met, at least in part, by the present invention where, in one aspect, a method for maximizing mass transfer efficiency in a mixer containing a liquid or liquid suspension is provided, comprising the steps of: selecting a desired mass transfer value for an impeller; selecting an impeller; selecting a Standard Aeration Efficiency; selecting a Froude Number value for the impeller that corresponds to the Standard Aeration Efficiency; Analyzing the Standard Aeration Efficiency relative the Froude number value; and determining the optimum impeller rotational speed and optimum diameter for the impeller.

In accordance with another aspect of the present invention, a method for maximizing mass transfer efficiency in a mixer containing a liquid or liquid suspension is provided, comprising the steps of: selecting a desired mass transfer value for an impeller; selecting an impeller; selecting a Standard Aeration Efficiency; selecting a Surface Power Density value for the impeller that corresponds to the Standard Aeration Efficiency; analyzing the Standard Aeration Efficiency relative to the surface Power Density value; and determining the optimum power utilized to operate the mixer per surface area of the liquid.

In accordance with still another aspect of the present invention, a method for maximizing mass transfer efficiency in a mixer containing a liquid or liquid suspension is provided, comprising the steps of: determining a mass transfer efficiency value range for an impeller; selecting a desired mass transfer value for the impeller; identifying the impeller's diameter; identifying the impeller's revolutions per minute that corresponds to the desired mass transfer value; determining a Froude Number value that corresponds to the desired mass transfer value; and utilizing the Froude Number value to obtain the desired mass transfer efficiency of the mixer.

In accordance with yet another aspect of the present invention, method for maximizing mass transfer efficiency in a mixer assembly having an impeller and mixing vessel containing a liquid or liquid suspension is provided, comprising the steps of: determining a mass transfer efficiency value range for the mixing assembly; selecting a desired mass transfer value for mixing assembly; determining the power level required to circulate the liquid per the surface area of the liquid at the desired mass transfer value; determining the Surface Power Density value that corresponds to the desired mass transfer value; and determining a desired liquid surface area utilizing the Surface Power Density value.

In accordance with another aspect of the present invention, a method for maximizing transfer efficiency in a mixer having an impeller and containing a liquid or liquid suspension is provided, comprising the steps of: selecting a desired mass transfer value for the impeller; providing a desired operational speed at which to operate the mixer; selecting a desired Froude Number value; utilizing the desired Froude Number value to determine the diameter of the impeller; and utilizing the determined impeller diameter and the desired speed to calculate a desired power level required to circulate the liquid per surface area of the liquid.

In accordance with yet another aspect of the present invention, a method for maximizing transfer efficiency in a mixer having an impeller and containing a liquid or liquid suspension is provided, comprising the steps of: selecting a desired mass transfer value for the impeller; providing a desired operational diameter of the impeller; selecting a desired Froude Number value; utilizing the desired Froude Number value to determine a desired operational speed; and utilizing the determined operational speed and the desired diameter to calculate a desired power level required to circulate the liquid per surface area of the liquid.

There has thus been outlined, rather broadly, several features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
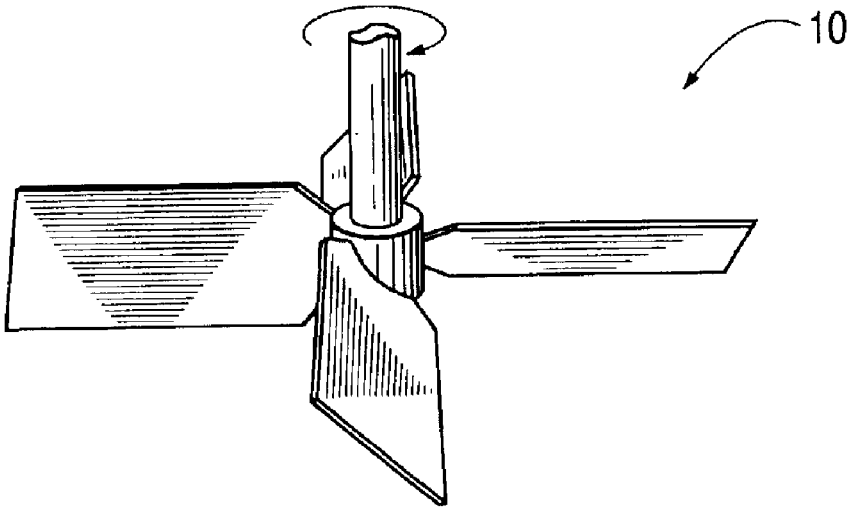
FIG. 1 is a perspective view of a standard pitched blade turbine utilized in a mass transfer process in accordance with the present invention.

The present invention provides a process for efficient mass transfer of gas or other fluids into a liquid and/or liquid suspension. The process is preferably used in conjunction with waste treatment processes and/or fermentation processes that are commonly carried out in a mixing vessel. In such an arrangement, the mass transfer process is utilized to contact oxygen gas to liquid in a mixing vessel and is referred to as pounds of oxygen per hour transferred to the liquid per horsepower or the Standard Aeration Efficiency (SAE) which is equal to the Standard Oxygen Transfer Rate or value (SOTR) divided by the shaft horsepower. It should be understood, however, that the present invention is not limited in its application to waste treatment, but, for example, can be used with other processes requiring efficient gas-liquid contact.

It has been discovered in accordance with the present invention that there is a peak in the mass transfer efficiency for various impellers and impeller configurations utilized in mass transfer apparatuses as a function the impeller's Froude Number relative to the SAE. Further, it has been discovered in accordance with the present invention that there is a peak in the mass transfer efficiency for various impellers and impeller configurations of mixing vessels as a function of the Surface Power Density of the impellers relative to the SAE. Thus, the efficiency in waste treatment processes and other mass transfer processes can be maximized in terms of delivering pounds of oxygen per hour to the liquid per horsepower.

It is understood that the Froude Number as applied in this context, a mixing vessel employing an impeller to transfer oxygen to a fluid or semi-solid fluid, is the ratio of inertia forces to the buoyancy forces. It is the function of the parameter that determines the wave action of waves. In mixing applications, the Froude Number is equal to the impeller rotational speed, N squared multiplied by the diameter (D) of the impeller divided by a constant C, where C is the speed of gravity multiplied by any conversion factors required (these factors on dependent upon the units of N and D), N is revolutions per minute (RPM) and D is measured in inches then C equals $1.39*10^6$. This equation is an example of an equation that may be used to obtain a Froude Number value. Other equations, for example, functions that yield a result proportional to the Froude Number, may be used. If the Froude Number is too low, insufficient energy exists in the surface wave of the liquid to generate ample splashing to allow for significant oxygen transfer to the liquid. Alternatively, if the Froude Number is too high, there is too much kinetic energy. The excess amount of kinetic energy causes the impeller blades to skim across the surface of the liquid and not pump the fluid adequately, resulting in inefficient oxygen transfer. However, through the above-described equation, an optimum SAE for a gas to liquid transfer for a mixing assembly can be obtained.

As previously described, the efficiency of mass transfer may also be optimized by analyzing the Surface Power Density relative to the SAE. It is understood that Surface Power Density is equal to the horsepower (used to operate the mixer) per one thousand square feet of liquid surface area (horsepower/1000 $ft.^2$ surface area). The equation is an example of an equation that may be used to obtain a power per area value. Other equations, for example, functions that yield a result proportional to the power per area value, may be used. The physics behind the Surface Power Density are such that at low power there is an insufficient amount of turbulence on the surface of the liquid to maximize transfer of gas to the liquid. Alternatively, at high power densities, the transfer process can also be inefficient. This is due to the fact that the spray may be so great that it impacts the vessel walls and loses its energy on the walls verses imparting the energy to the liquid surface to increase the turbulence and optimize oxygen transfer. Furthermore, as more energy is imparted onto the liquid surface, more liquid is aerated, creating a very low density liquid, which puts a greater load on the impeller, because it is more difficult to pull low density liquid down into the mixing vessel. However, again, through the above-described Surface Power Density equation, an optimum SAE for a mixing assembly can be obtained.

Figure 3:
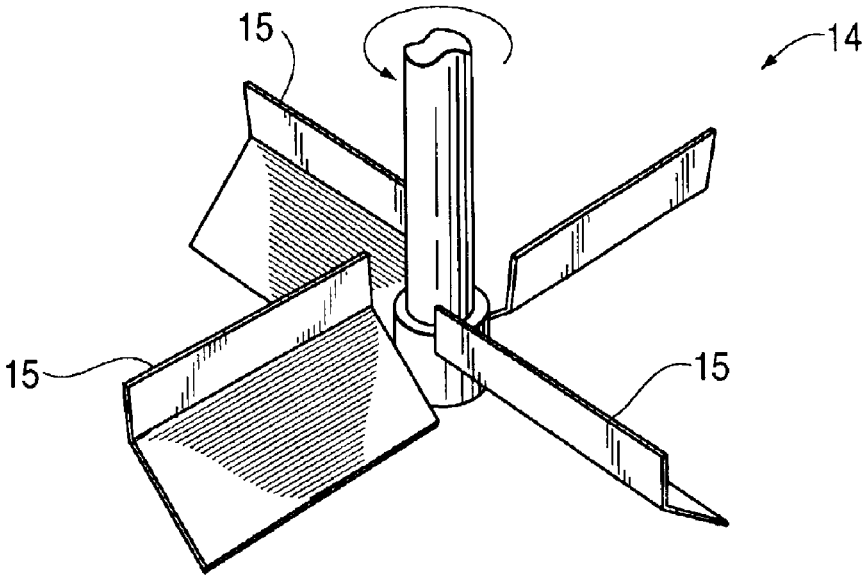
FIG. 3 is a perspective view of an impeller having a vertical extension utilized in a mass transfer process in accordance with the present invention.
Figure 4:
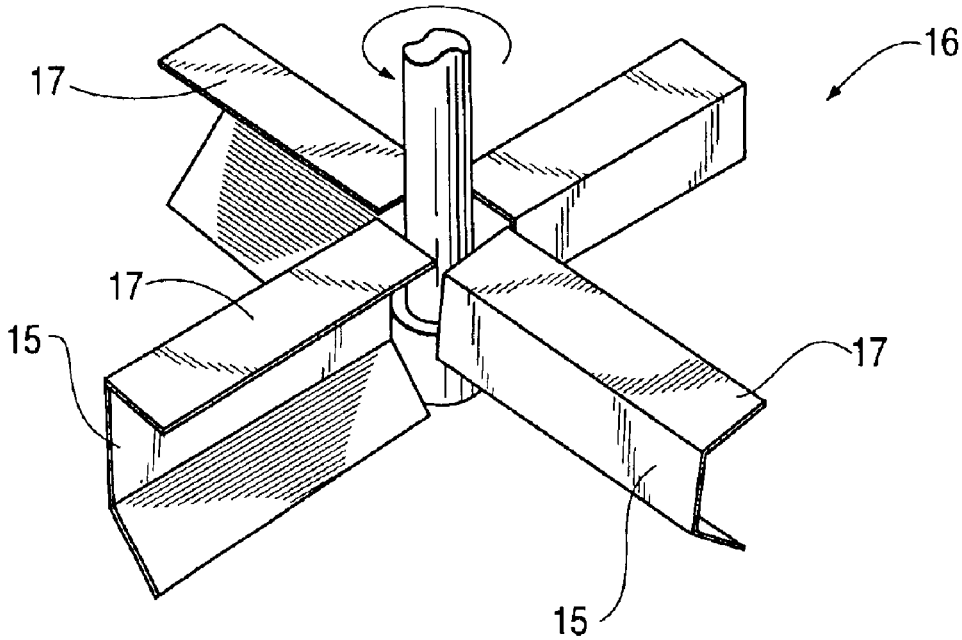
FIG. 4 is a perspective view of an impeller having both vertical and horizontal extensions utilized in a mass transfer process in accordance with the present invention.
Figure 5:
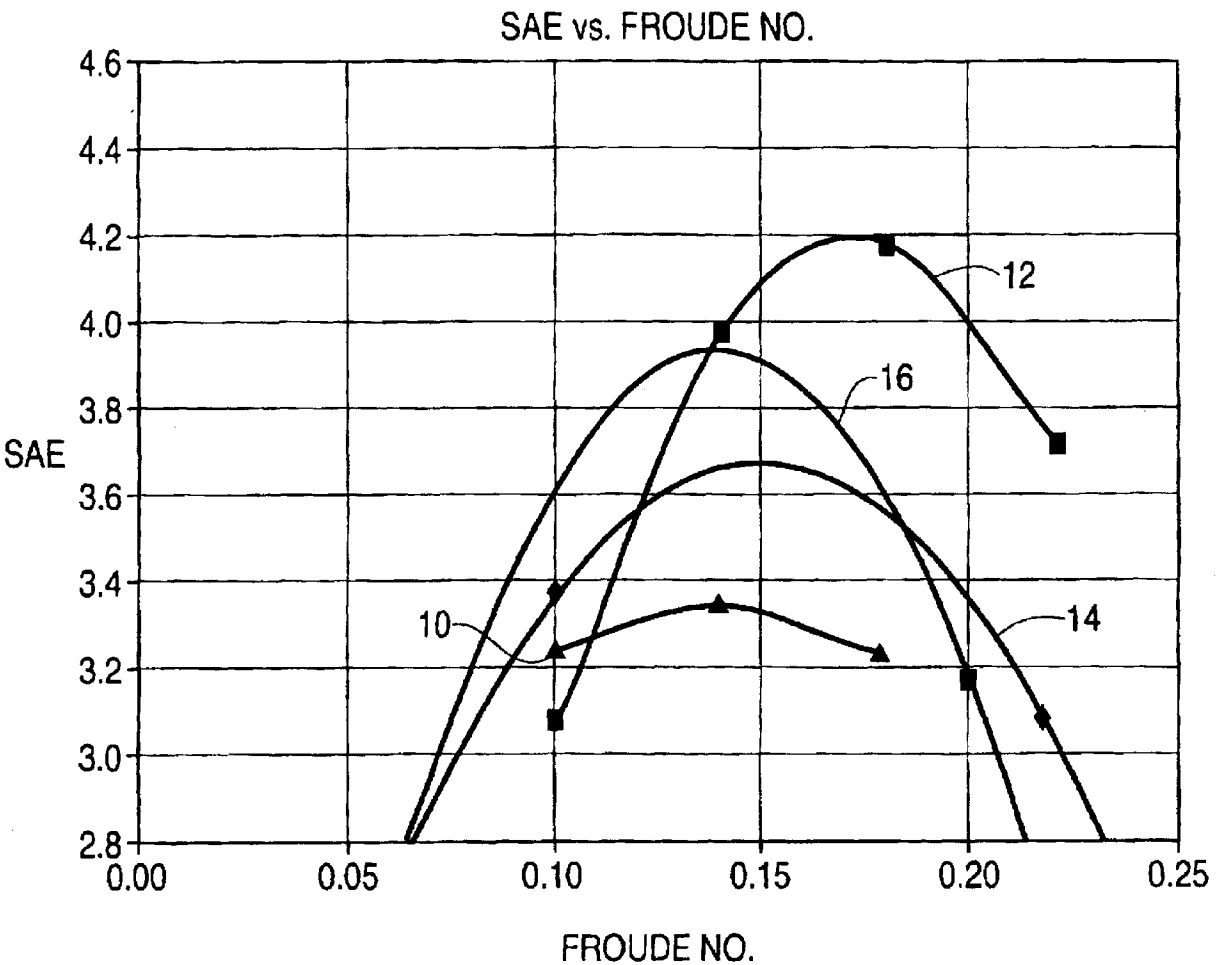
FIG. 5 is graph depicting the Standard Aeration Efficiency values for the impellers illustrated in FIGS. 1–4 relative to the Froude Number values.
Figure 6:
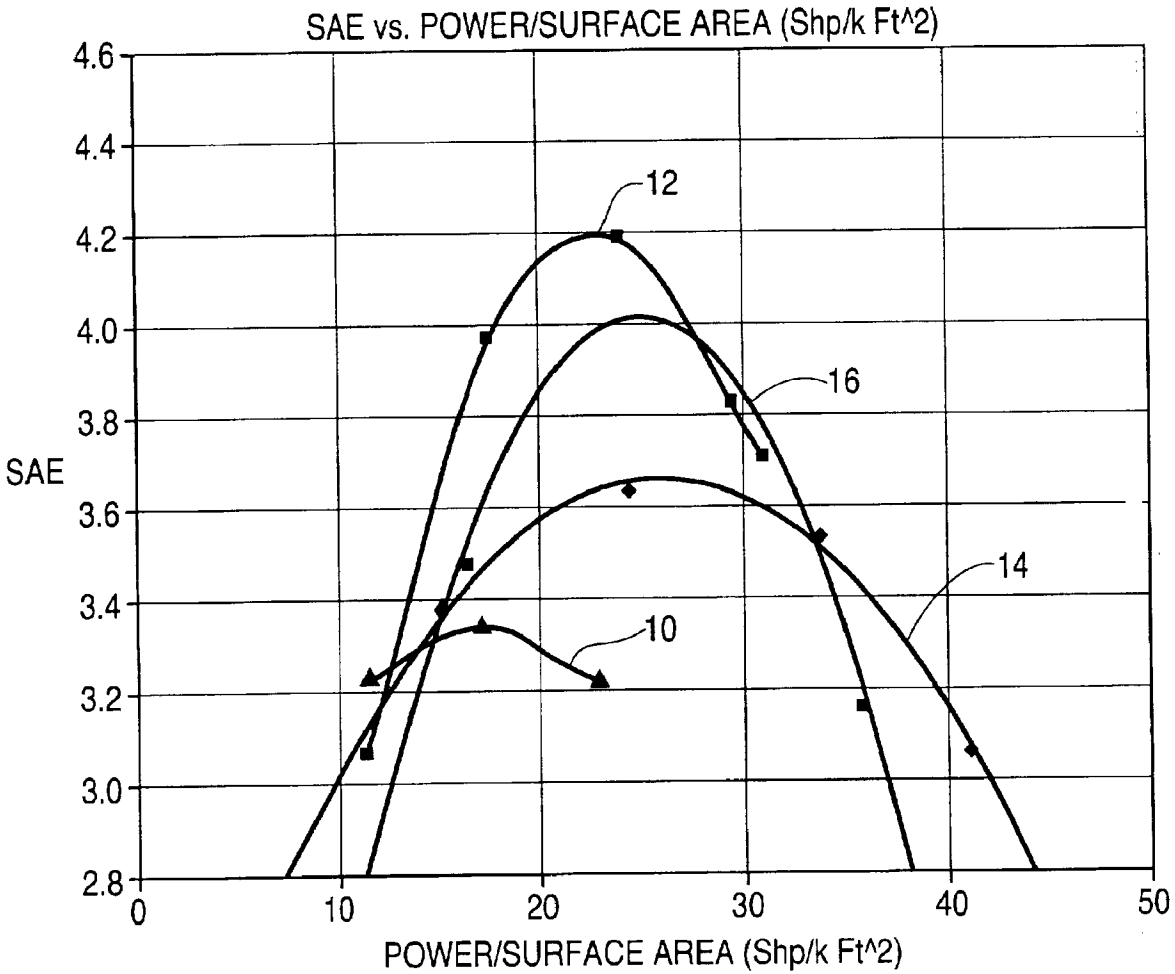
FIG. 6 is graph depicting the Standard Aeration Efficiency values for the impellers illustrated in FIGS. 1–4 relative to the Surface Power Density values.

Referring now to the figures, wherein like reference numerals indicate like elements, FIGS. 1–7 depict a series of impellers and their corresponding SAE values relative to the Froude Number values and Surface Power Density values. FIGS. 5 and 6 depict the peak SAE efficiency curve for the impellers illustrated in FIGS. 1–4 as a function of the Froude Number value and Surface Power Density value, respectively. The SAE efficiency curves depicted were obtained by operating the impellers referenced in FIGS. 1–4 according to the maximum and minimum test conditions and parameters illustrated in Table I below. The location and values of the peak SAE may vary with different installation geometries and impeller submergence.

TABLE I

| | A200 min | A200 max | A240 min | A240 max | A245 min | A245 max | R335 min | R335 max |
|---|---|---|---|---|---|---|---|---|
| Speed rpm | 27 | 51 | 37 | 58 | 35 | 55 | 42 | 105 |
| Diameter inch | 96 | 148 | 83 | 113 | 95 | 118 | 60 | 103 |
| Diameter Tank Equivalent, inch | 663 | 831 | 663 | 960 | 663 | 831 | 663 | 960 |
| Power, shaft Hp | 23 | 137 | 129 | 213 | 33 | 152 | 13 | 198 |
| Shp/k ft^2 | 9.8 | 36.5 | 13 | 47 | 14 | 58 | 5.5 | 82 |
| Froude No. | 0.055 | 0.180 | 0.100 | 0.230 | 0.084 | 0.210 | 0.096 | 0.480 |
| Volume, gal | 201,000 | 481,000 | 196,000 | 566,000 | 298,000 | 474,000 | 194,000 | 547,000 |
| Depth, inch | 134 | 321 | 129 | 216 | 161 | 317 | 117 | 340 |
| No. of Runs | 64 | | 107 | | 44 | | 115 | |

Referring now to FIG. 1, a pitched blade turbine 10 that splashes on the surface of the liquid is depicted. As can be observed on FIGS. 5 and 6, the impeller's 10 optimum SAE value is approximately 3.3 (delivers 3.3 pounds of oxygen per hour to the liquid per horsepower) at a Froude Number value of about 0.14 to about 0.15 and a Power Surface Density value number of about 15.0 to about 18.0. Thus, when employing a standard pitched turbine 10, the SAE can be maximized by either using the Froude Number value and its corresponding equation or the Surface Power Density value and its corresponding equation.

When utilizing the Froude Number value to maximize efficiency, the optimum value is approximately 0.14, the therefore impeller rotational speed (RPM in the test conditions) and the impeller diameter can be modified accordingly, to achieve maximum SAE efficiency. Similarly, the optimum Surface Power Density value is about 15.0 to about 18.0 and therefore mixing vessel dimensions (liquid surface area) and the power level required to circulate the liquid may be adjusted accordingly to obtain maximum gas to liquid transfer efficiency.

Figure 2:
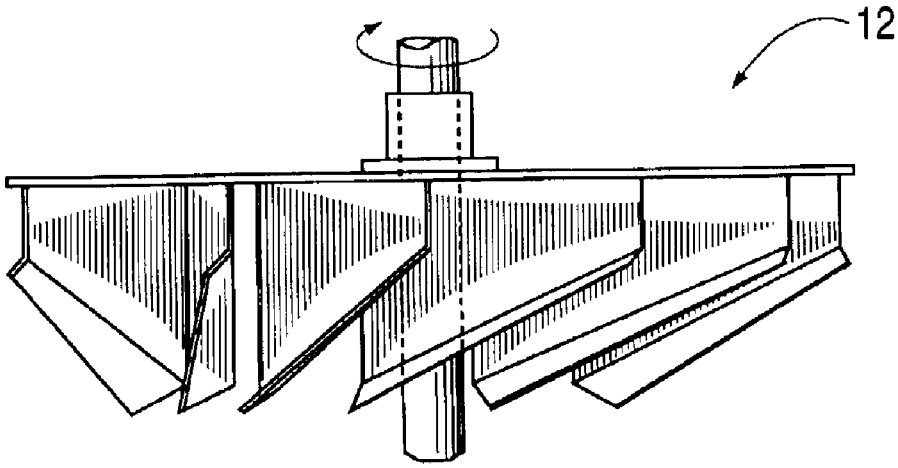
FIG. 2 is a perspective view of a disc surface aerator impeller utilized in a mass transfer process in accordance with the present invention.

FIG. 2 depicts a disc surface aerator impeller 12. As can be observed on FIGS. 5 and 6, the impeller's 12 optimum SAE value is approximately 4.2 (delivers approximately 4.2 pounds of oxygen per hour to the liquid per horsepower). When using this impeller 12, the maximum efficiency Froude Number value is about 0.16 to about 0.18 and the Power Surface Density value is about 22.0 to about 25.0. Thus, when employing a disc surface aerator impeller 12, the SAE can be maximized by either using the Froude Number value and its corresponding equation or the Surface Power Density value and its corresponding equation.

When utilizing the Froude Number value, the optimum value is approximately 0.17, therefore impeller rotational speed (RPM in the test conditions) and the impeller diameter can be modified accordingly, to achieve SAE efficiency. Similarly, the optimum Surface Power Density value is about 25.0 and therefore mixing vessel dimensions (liquid surface area) and the power level required to circulate the liquid may be adjusted accordingly to obtain maximum gas to liquid transfer efficiency.

Referring now to FIG. 3, an impeller 14 having a vertical extension 15 utilized in a mass transfer process is illustrated. Again, as can be observed on FIGS. 5 and 6, the impeller's 14 optimum SAE value is approximately 3.67 (delivers approximately 3.67 pounds of oxygen per hour to the liquid per horsepower). In order to obtain maximum efficiency, the Froude Number value should be about 0.13 to about 0.17 and the Power Surface Density value number should be about 20.0 to about 30.0 as depicted on FIGS. 5 and 6. Thus, when employing an impeller 14 such as the one depicted in FIG. 3, the SAE can be maximized by either using the Froude Number value and its corresponding equation or the Surface Power Density value and its corresponding equation.

When utilizing the Froude Number value, the optimum value is approximately 0.15, therefore impeller rotational speed (RPM in the test conditions) and the impeller diameter can be modified accordingly, to achieve SAE efficiency. Similarly, the optimum Surface Power Density value is about 20.0 to about 30.0 and therefore mixing vessel dimensions (liquid surface area) and the power level required to circulate the liquid may be adjusted accordingly to obtain maximum gas to liquid transfer efficiency.

FIG. 4 depicts an impeller 16 having both vertical and horizontal extensions 15 and 17 respectively, utilized in a mass transfer process. As can be observed on FIGS. 5 and 6, the impeller's 16 optimum SAE value is approximately 4.0 (delivers approximately 4.0 pounds of oxygen per hour to the liquid per horsepower). As illustrated by the efficiency curve of FIG. 5, the optimum Froude Number value is about 0.12 to about 0.14. As depicted by FIG. 6, the optimum Power Surface Density value is about 23.0 to about 28.0. Thus, when employing an impeller 16, such as the one depicted in FIG. 4, for example, the SAE can be optimized by either using the Froude Number value and its corresponding equation or the Surface Power Density value and its corresponding equation.

When utilizing the Froude Number value to maximize mass transfer efficiency, the optimum value is about 0.12 to about 0.14, therefore the impeller rotational speed (RPM in the test conditions) and the impeller diameter can be modified accordingly, to achieve maximum SAE efficiency. Similarly, the optimum Surface Power Density value figure is about 23.0 to about 28.0 and therefore mixing vessel dimensions (liquid surface area) and the power level required to circulate the liquid may be adjusted accordingly to obtain maximum gas to liquid transfer efficiency.

It should be understood that the above described impellers and corresponding test data are representative examples only, used to demonstrate how the Froude Number and the Surface Power Density values can maximize mass transfer efficiency. The Froude Number and Surface Power Density values can be utilized to maximize the mass transfer efficiency of various impeller and mixing systems.

For example, the optimum Froude and Surface Power Density values can be determined for virtually any impeller design, similarly to the above-referenced impeller examples. Upon this determination, a table of attributes that includes SAE values relative to both Froude and Surface Power Density values can be provided which will enable the efficiency of virtually any mass transfer assembly to be maximized. Alternatively, certain applications may be limited by vessel size, impeller design, and/or power level or certain applications may require a specific vessel size, impeller design and/or power level. Given the restraints or requirements of the mixing system, the Froude Number and Surface Power Density values can be maximized to the system's mass transfer efficiency.

In accordance with another embodiment of the present invention, the mass transfer efficiency of a mixer or mixer assembly can be optimized by employing multi-step processes that utilize the Froude Number value and/or the Surface Power Density value as parameters.

One multi-step process includes first determining a mass transfer efficiency range for an impeller. This step can be accomplished by determining a mass transfer efficiency value range for an impeller. This is preferably accomplished by performing a series of trial runs in a mixing vessel wherein the rotational speeds and power level are varied and the resulting oxygen transfer rates are plotted and recorded, providing an transfer efficiency curve. Next, the desired mass transfer value is selected from the transfer efficiency curve. Preferably, this value is the optimum oxygen transfer efficiency. Next, the impeller's diameter and the revolutions per minute (RPM) that correspond to the desired mass transfer value are recorded. Finally, the Froude Number value that corresponds to the desired mass transfer value is determined by utilizing the formula: Froude Number=$N^2$(Impeller Diameter (D))/Constant (C), where C is $1.39\times10^6$, N is revolutions per minute and D in measure in inches. The determined Froude Number value may now be used as a parameter to design and manufacture efficient oxygen transfer impellers. Please note the above described steps of the process are not limited to the order in which they are described and may be carried out in various combinations.

Another multi-step process in an accordance with an embodiment of the present invention includes first determining a mass transfer efficiency range for a mixer system. This step, like the previous described process, can be accomplished by first determining a mass transfer efficiency value range for the particular mixing system. This is preferably accomplished by performing a series of trial runs in a mixing vessel wherein the rotational speeds and power level of the mixing system are varied and the resulting oxygen transfer rates are plotted and recorded, providing an transfer efficiency curve. Next, the desired mass transfer value is selected from the transfer efficiency curve. Preferably, this value is the optimum oxygen transfer efficiency. Next, the power level required to circulate the liquid in the vessel per the surface area of the liquid at the desired mass transfer value is determined. Finally, the Surface Power Density value that corresponds to the desired mass transfer value is determined by utilizing the formula: Surface Power Density=horsepower per one thousand square feet of liquid surface area. The determined Surface Power Density value may now be used as a parameter to maximize the oxygen transfer efficiency of mixers and mixer assemblies. Please note the above described steps of the process are not limited to the order in which they are described and may be carried in various combinations.

Preferably, both of the above described processes are used in combination with one another wherein the determined Froude Number value and the determined Surface Power Density value are both used as parameters to design and manufacture efficient oxygen transfer impellers and mixing systems. In addition, both these values may also be utilized to optimize the oxygen transfer efficiency of impellers and mixing already in existence.

Furthermore, both of the aforementioned processes can be optimized in terms of SAE efficiency by adjusting the submergence level of the impeller within the liquid contained in the mixing vessel.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for configuring and controlling operation of a mixer containing a liquid or liquid suspension, comprising:

selecting a desired mass transfer value for an impeller;

selecting an impeller to be submerged in the liquid or liquid suspension;

selecting a desired Standard Aeration Efficiency value;

selecting a desired Froude Number value for the impeller that corresponds to the Standard Aeration Efficiency value using a predetermined relationship between the Froude Number value and the Standard Efficiency Value for the selected impeller obtained by operating the impeller;

determining a desired impeller rotational speed and a desired diameter for the impeller; and operating the mixer using the impeller having the determined desired diameter.

2. The method according to claim 1, further comprising:

selecting a Surface Power Density value for the impeller that corresponds to the desired Standard Aeration Efficiency value using a predetermined relationship between the Standard Aeration Efficiency value and the Surface Power Density value for the selected impeller obtained by operating the impeller; and determining a desired power level required to circulate the liquid per surface area of the liquid.

3. The method according to claim 2, further comprising the step of comparing the analysis of the desired Standard Aeration Efficiency value relative to the Froude Number value to the analysis of the desired Standard Aeration Efficiency value relative to the Surface Power Density value.

4. The method according to claim 1, wherein the step of determining the desired impeller rotational speed and optimum diameter of the impeller includes determination based on the formula: Froude Number=$N^2$(Impeller Diameter (D))/Constant (C), where C is $1.39\times10^6$, N is revolutions per minute and D in measure in inches.

5. The method according to claim 2, wherein the step of determining the desired power level required to circulate the liquid includes determination based on the formula: Surface Power Density=horsepower per one thousand square feet of liquid surface area.

6. The method according to claim 3, further comprising the step of adjusting the submergence level of the impeller.

7. A method for configuring and controlling operation of a mixer containing a liquid or liquid suspension, comprising:

selecting a desired mass transfer value for an impeller;

selecting an impeller to be submerged in the liquid or liquid suspension; and selecting a desired Standard Aeration Efficiency value that corresponds to a Surface Power Density value for the impeller using a predetermined relationship between the Surface Power Density value and the Standard Efficiency Value for the selected impeller obtained by operating the impeller;

determining a desired power level required to circulate the liquid per surface area of the liquid operating the mixer using the determined desired power level.

8. The method according to claim 7, further comprising:

selecting a Froude Number value for the impeller that corresponds to the desired Standard Aeration Efficiency value using a predetermined relationship between the Froude Number value and the Standard Efficiency Value for the selected impeller obtained by operating the impeller;

analyzing the desired Standard Aeration Efficiency value relative the Froude Number value; and determining a desired impeller rotational speed and a desired diameter for the impeller.

9. The method according to claim 8, further comprising the step of comparing the analysis of the desired Standard Aeration Efficiency value relative to the Froude Number value to the analysis of the desired Standard Aeration Efficiency value relative to the Surface Power Density value.

10. The method according to claim 9, further comprising the step of adjusting the submergence level of the impeller.

11. The method according to claim 7, wherein the step of determining the desired impeller rotational speed and the desired diameter of the impeller includes determination based on the formula: Froude Number=$N^2$(Impeller Diameter (I)))/Constant (C), where C is $1.39\times10^6$, N is revolutions per minute and D in measure in inches.

12. The method according to claim 7, wherein the step of determining the desired power level required to circulate the liquid per surface area of the liquid includes analysis based on the formula: Surface Power Density=horsepower per one thousand square feet of liquid surface area.

* * * * *

UNITED STATES PATENT AND TRADEMARK OFFICE

CERTIFICATE OF CORRECTION

PATENT NO. : 6,986,507 B2
DATED : January 17, 2006
INVENTOR(S) : Ronald J. Weetman It is certified that error appears in the above-identified patent and that said Letters Patent is hereby corrected as shown below:

Column 10,
Lines 11 and 12, delete "Froude Number=$N^2$ (Impeller Diameter (I)))/Constant (C)," and insert -- Froude Number=$N^2$ (Impeller Diameter (D))/Constant (C) --.

Signed and Sealed this

Twenty-eighth Day of March, 2006

JON W. DUDAS
*Director of the United States Patent and Trademark Office*